United States Patent [19]

Frey

[11] Patent Number: 4,702,038

[45] Date of Patent: Oct. 27, 1987

[54] DOOR SEAL PACKING, ESPECIALLY FOR DOORS WITH OR WITHOUT THRESHOLDS

[76] Inventor: Harry Frey, Untere Gasse 24, 8950 Kaufbeuren-Oberbeuren, Fed. Rep. of Germany

[21] Appl. No.: 909,951

[22] Filed: Sep. 22, 1986

[30] Foreign Application Priority Data

Sep. 21, 1985 [DE] Fed. Rep. of Germany ..... 3533782

[51] Int. Cl.[4] ..... E06B 7/16

[52] U.S. Cl. ..... 49/478; 46/470

[58] Field of Search ..... 49/478, 469, 470, 304, 49/305

[56] References Cited

U.S. PATENT DOCUMENTS 3,124,725 3/1964 Leguillon ..... 49/478 X 3,487,581 1/1970 Ellingson, Jr. ..... 49/478

3,604,152 9/1971 Protzman ..... 49/470

4,413,446 11/1983 Dittrich ..... 49/470

*Primary Examiner*—Kenneth Downey

*Attorney, Agent, or Firm*—Holman & Stern

[57] ABSTRACT

The invention illustrates a door seal comprising a permanently magnetic sealing member along the underneath edge of the door which at the end of the closing action moves at right angles to the direction of closing into the sealing position, and which co-operates with a magnetically active counterpart, whereby the movable sealing member and the counterpart run parallel in the closed position of the door, and the sealing member and/or the counterpart are guided so that they are movable.

7 Claims, 5 Drawing Figures

DOOR SEAL PACKING, ESPECIALLY FOR DOORS WITH OR WITHOUT THRESHOLDS

The invention relates to a door seal or packing, especially for doors with or without a threshold, in which at the end of the closing action a sealing member moves into the sealing position at right angles to the direction of closing.

In the case of doorways without thresholds and without a step the problem of sealing, particularly against noise, light and draughts, arises. In order to solve this problem door sealing means are known which are for instance fitted to the bottom of the doors and which drag over the floor every time the doors move. This means that the door seals of this kind suffer a great deal of wear and the closing and opening action of the doors is made much more difficult.

Another known device provides a profile which is set into the underneath edge of the doors and receives a sealing strip. The sealing strip is dropped down by a release mechanism when the door is closed and is raised again mechanically when the door is opened. With this design a groove must be provided on the underneath edge of the door which can received the profile. Such a groove cannot however be provided as standard on doors because the doors frequently have to be planed down at the bottom to make them fit. The groove therefore has to be made subsequently for each door before the profile if fitted. The design is, morever, very expensive and susceptible to problems, for example collecting dirt. A further disadvantage is that the release mechanism which is to lower the seal only has a very short relase distance available. Because of this short release distance a failure of the door seal cannot be ruled out. If the doors are not fitted absolutely accurately or if they drop down subsequently the reliability is considerably impaired.

The object of the invention is to provide a door seal which works reliably and which can be fitted subsequently in a simple manner.

BRIEF DESCRIPTION OF THE INVENTION

The invention therefore provides a door seal of the type described above in which a permanently magnetic sealing member interacts along the bottom edge of the door with a magnetically active counterpart member, whereby the permanently magnetic sealing member and the counterpart member run parallel in the closed position of the door and the sealing member and/or the counterpart are guided so that they are moveable.

The use of permanent magnets has the big advantage that the magnetic members meet together, this means therefore that neither the closing action nor the opening action are impaired by the seal. If, for instance, the counterpart member is fitted on the underneath edge of the door then modification of the door by milling a groove is also no longer necessary. In this case the movable sealing member is seated in the floor and closes with its surface flush with the floor. In this way any danger of tripping over is ruled out. Other arrangements are of course also possible, for example the interaction of two movable sealing members or fitting the movable sealing member in the under edge of the door.

The counterpart member can be made of a ferromagnetic material or it can also be another permanent magnet.

It is an advantage if the permanent magnet or magnets have a pole arrangement in the longitudinal direction of the underneath edge of the door and so, in the closed position, the magnetic circuit is closed along the permanent magnet or magnets or the counterpart. Through this the magnetic forces do not become active until the door is almost closed so that when the door is closed the movable sealing member does not hinder the closing action nor does it, for instance, drag on the floor during the action of opening.

It is particularly expedient here if the north pole of the one permanent magnet is opposite the south pole of the other permanent magnet and vice versa.

Thus, development of the magnetic closing parallel to the bottom edge of the door is guaranteed.

In one embodiment of the invention the movable sealing member is seated in a flat sill on the floor. This form of design is particularly suitable if it is not desirable to fit a groove in the floor. The sill can be kept sufficiently flat here so there is no danger of tripping over. Through suitable colour design of the sill a pleasing appearance is achieved.

Furthermore, a sealing member which can be sunk into the floor can be designed on its surface in such a way that it does not project compared with the rest of the floor.

It has proved particularly favourable if the operative surfaces of the sealing member and counterpart member which meet against each other are shaped concave or convex respectively. It is preferable here if the part of the seal which is seated in the floor is shaped convexly. This ensures that particles of dirt do not remain lying on the sealing member, it makes cleaning easy and also ensures that the sealing action is fully effective even if there is unevenness or wear.

A return force acts on the movable sealing member. The return force can be the force of gravity. This applies when the movable sealing member is seated in the floor and simply drops down when the door is opened. Spring forces or leverage can however also become active if the movable sealing member sits for instance in the underneath edge of the door and is lifted by a spring when the door is opened.

The spring force here must be designed such that it is slightly weaker than the magnetic force.

In a preferred embodiment of the invention the movable sealing member is seated in a U-shaped guide. In the U-shaped guide is, for instance, a groove which runs in the floor the movable sealing member can be taken out easily for cleaning purposes. Such a guide can also be fitted easily subsequently in the floor.

In another embodiment of the invention the movable sealing member sits on a bar. The bar can also be fitted subsequently in the floor for instance, without difficulty. Here too, the movable sealing member is easily pulled out upwardly for cleaning purposes. The material of which the guides are made is for instance aluminium or another material which does not impair the magnetic action.

BRIEF DESCRIPTION OF THE DRAWINGS

There will now be described an example of a door seal according to the invention. The description which is to be read with reference to the drawings is given by way of example only and not by way of limitation.

In the drawings.

DETAIL DESCRIPTION OF THE EMBODIMENT

Figure 1:
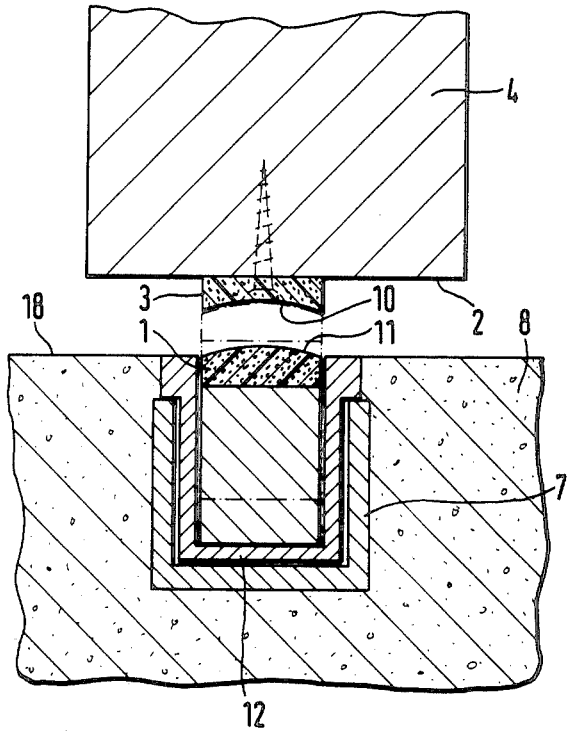
FIG. 1 shows a section through a door seal in accordance with the invention.

In the preferred embodiment of the invention, a movable permanently magnetic sealing member 1 in a U-shaped guide 12 is seated in the U-rail 7 which is embedded in the floor 8. At their ends the U-shaped guide 12 and the sealing member close with the underneath edge of the door 4 which is not shown in detail. The U-shaped guide 12 is preferably made of aluminium and must be designed such that the movable sealing member 1 is held by it even in the raised state. The movable sealing member 1 is made of a deformable material and in the top part contains a parmanent magnet in the form of a strip. A lamellar, flexible material is particularly suitable as the permanent magnet. In the dropped down position the upper active surface 11 closes flush with the surface 18 of the floor 8. The operative surface 11 of the movable sealing member 1 is curved slightly convexly and can be coloured such that it does not stand out visually from the rest of the floor surface.

The underneath edge 2 of the door, which carries the counterpart member 3, is also shown in FIG. 1. The counterpart member 3 consists either of a permanent magnet or of another magnetically active material. As shown in FIG. 1 the counterpart member 3 can be secured in a simple manner on the underneath edge 2 of the door, for example by screwing on. This also facilitates subsequent fitting. The operative surface 10 of the counterpart 3, that is its underside, has a concave curvature which matches the convex curvature of the sealing member 1.

Figure 3:
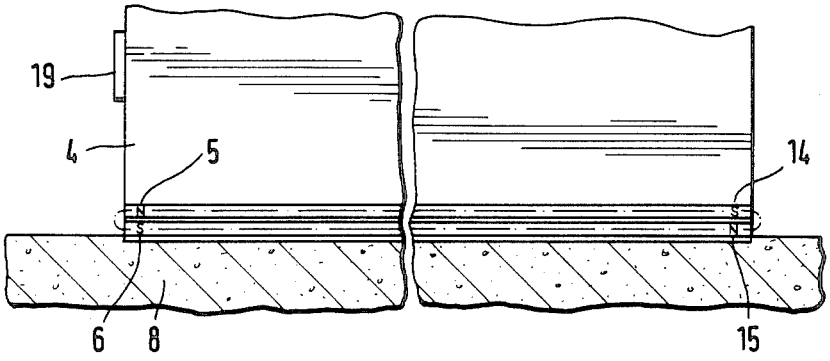
FIG. 3 shows a partial view of a door in the closed position.
Figure 4:
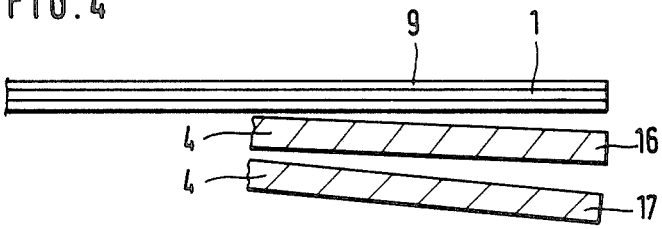
FIG. 4 shows a plan view of the view in FIG. 3.

If the counterpart member 3 also consists of a permanent magnet then this is preferably arranged such that the north pole 5 of the counterpart 3 lies opposite to the south pole 6 of the movable sealing member 1 and likewise the south pole 14 of the counterpart 3 lies opposite to the north pole 15 of the movable sealing member 1. In this way a magnetic seal is achieved along the under edge of the door, this being indicated by the dot-dash lines in FIG. 3. This arrangement has the advantage that the magnetic circuit is not closed until the door is already almost completely closed, as shown by position 16 in FIG. 4. In position 17 in FIG. 4 the magnets are not yet active which facilitates opening and closing of the door. The lower hinge plate is designated by 19.

Figure 2:
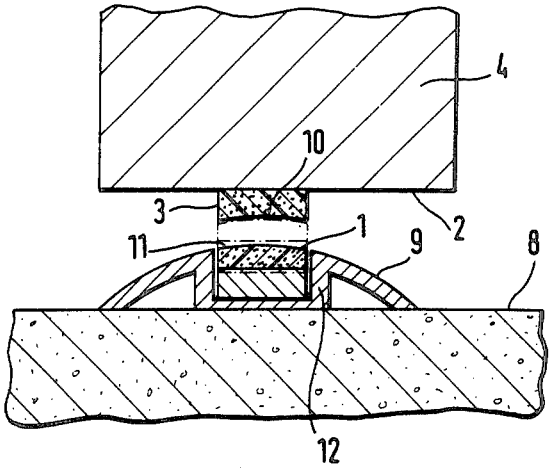
FIG. 2 shows a sectional view of a modified form.

FIG. 2 shows an embodiment of a door seal in accordance with the invention which is particularly suitable for subsequent fitting. With this the movable sealing member 1 is seated in a threshold 9 which can be held sufficiently flat that it does not present any risk of stumbling. The guide for the sealing member 1 is formed directly on the threshold 9.

Figure 5:
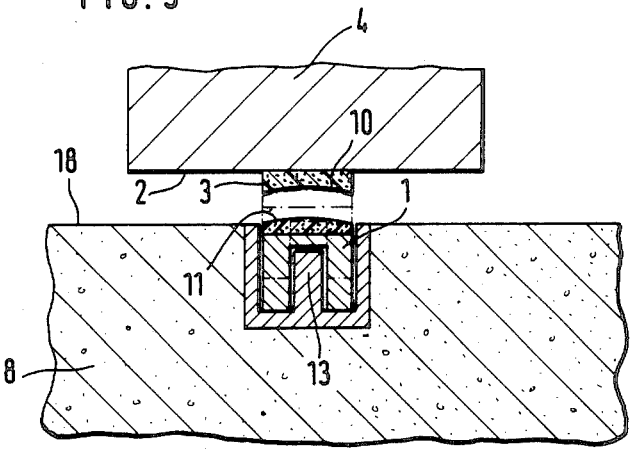
FIG. 5 shows a sectional view of another modification of the invention.

A further variant is represented in FIG. 5. Here the movable sealing member 1 is seated on a bar 13. The bar 13 has the same purpose as the U-shaped guide 12, namely to guide the sealing member.

Other variants are of course also possible, for example the movable sealing member can also be built in to the underneath edge of the door and recessed therein with the help of a tongue or the like. It is also possible to fix the movable sealing member in the underneath edge of the door with a bellows or another resilient element which takes over the job of retraction in the opening position and at the same time also serves as a guide device.

FIGS. 1, 2 and 5 show the door seal in a non-functioning position which is the case when the door is open. The sealing position in each case is indicated with dot-dash lines.

I claim:

1. A door seal assembly suitable for use with doors having door frames with or without a threshold, comprising two mutually confronting members, being a first elongate sealing member and a second elongate sealing member, one of said members being securable to an underneath edge surface of the door and the other one to the confronting surface of a floor at least one of said first and second members comprising a permanent magnet and the other of said first or second members being selected from a permanent magnet and a portion of magnetizable material, wherein one of said members, when the door is in the closed position, moves in a direction at right angles to the direction of closure of the door wherein the first and second sealing members extend parallel to each other when the door is in the closed condition, guide means are provided to guide the movement of said one of the sealing members and wherein at least said one of said sealing members has opposite magnetic poles at its respective ends providing an opposite pole arrangement between the sealing members in a lengthwise direction of said edge surface of the door whereby, in closed position of the door, a magnetic circuit is closed along the length of the sealing members.

2. Door seal as claimed in claim 1, wherein the sealing members are both permanent magnets with opposite poles at their respective ends and the north pole of the one permanent magnet is coordinated with the south pole of the other permanent magnet and vice versa.

3. Door seal as claimed in claim 1, wherein a groove is provided in the floor beneath the door in its closed position and the movable sealing member is fitted into said groove.

4. Door sealing as claimed in claim 1 wherein the one sealing member is disposed in a threshold.

5. Door seal as claimed in claim 1, wherein confronting faces of the sealing members have a concave or matching convex curvature.

6. Door seal as claimed in claim 1, wherein a U-shaped guide is provided to house the movable sealing member.

7. Door seal as claimed in claim 1, wherein a bar is provided for guiding the movable sealing member.

* * * * *